US006702492B2

(12) United States Patent
Saito

(10) Patent No.: US 6,702,492 B2
(45) Date of Patent: Mar. 9, 2004

(54) RECORDING APPARATUS

(75) Inventor: Hiroyuki Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/983,578

(22) Filed: Oct. 25, 2001

(65) Prior Publication Data

US 2002/0051670 A1 May 2, 2002

(30) Foreign Application Priority Data

Oct. 31, 2000 (JP) ..... 2000-332714

(51) Int. Cl.[7] ..... B41J 11/42
(52) U.S. Cl. ..... 400/582; 400/578
(58) Field of Search ..... 400/582, 578

(56) References Cited

U.S. PATENT DOCUMENTS 5,604,568 A * 2/1997 Iwama ..... 399/215
5,940,105 A 8/1999 Hayami
6,017,160 A * 1/2000 Sato et al. ..... 400/582
6,116,795 A * 9/2000 Ogasawara ..... 400/582
6,299,282 B1 10/2001 Hiramatsu ..... 347/37
6,454,474 B1 * 9/2002 Lesniak et al. ..... 400/582
2001/0055040 A1 * 12/2001 Nojima ..... 347/16

FOREIGN PATENT DOCUMENTS

EP 0 865 929 9/1998
EP 0 988 986 3/2000

* cited by examiner

*Primary Examiner*—Andrew H. Hirshfeld
*Assistant Examiner*—Hoai-An D. Nguyen
(74) *Attorney, Agent, or Firm*—Fitzpatrick, Cella, Harper & Scinto

(57) ABSTRACT

A recording apparatus comprises a conveying roller for conveying a recording medium, a conveying motor for generating driving force to drive the conveying roller, a driving transmitter for transmitting the driving force of the conveying motor to the conveying roller, a detector for detecting a rotation angle of the conveying roller, and a controller for controlling driving and stopping of the conveying roller on the basis of a signal from the detector, wherein a conveying quantity of the recording medium at a time of recording operation is an integer multiple of a conveying quantity of the recording medium corresponding to one period of a torque change or a speed change caused by the conveying motor or the driving transmitter, so that stop accuracy of the recording medium is not influenced by a torque (speed) ripple of the conveying motor or the transmitter.

10 Claims, 4 Drawing Sheets

RECORDING APPARATUS

BACKGROUND OF THE INVENTION

1. Field of the Invention

The present invention relates to a recording apparatus which forms an image on a recording medium such as a sheet or the like.

2. Related Background Art

In recent years, a decrease in operation sound, as well as improvement in image quality, is desired in a printer. Particularly, in an inkjet recording apparatus having few noise sources at a time of recording, a DC (direct current) motor and a linear encoder are adopted as a driving means to scan a recording head, thereby achieving a low-noise operation. Further, the DC motor and a rotary encoder are being adopted as a driving source to convey sheets. Although an effect of decreasing noise can be expected by only adopting the DC motor, a highly developed stop control technique and machine accuracy are needed to execute highly accurate conveying.

As a method of stopping the DC motor, basically, a method of turning off a power supply of the motor when the rotation of a roller to convey the sheet reaches a target position and thus stopping the motor by inertia is generally known.

To secure stop accuracy using the DC motor, it is necessary and indispensable to lower a prestop speed and eliminate prestop disturbance torque, i.e., to stabilize low-speed driving immediately before the motor stops. That is, a time until the motor stops can be shortened by turning off the power supply of the motor at a constant and sufficiently slow speed, and it becomes difficult to receive disturbance, whereby the stop accuracy of the motor can be secured.

To stabilize the low-speed driving immediately before the motor stops, various manners have been adopted. As a first manner, there is a manner to increase a quantity of information in the low-speed driving immediately before the motor stops and thus improve controllability by using an analog encoder so as to increase resolution of the rotary encoder. As a second manner, there is a manner to sufficiently enlarge the diameter of the rotary encoder (codewheel) as compared with that of the conveying roller to prevent accuracy decrease due to eccentricity of the encoder, and also to increase a peripheral speed of an encoder slit to increase the number of counts of the encoder slit during the low-speed driving immediately before the motor stops, so as to increase the quantity of information and thus improve the controllability.

However, since an extreme torque change is not contained in a torque change of a large period such as a revolution of the conveying roller, the disturbance torque can be eliminated and controlled by lowering to a certain extent the driving speed immediately before the motor stops. However, it is difficult to eliminate small-period disturbance torque, particularly disturbance torque due to a cogging torque ripple of a motor. To cope with this, servo control is executed until the last time that the motor stops by increasing the quantity of information during the low-speed driving immediately before the motor stops so as to suppress small-period torque change and speed change, and also the accuracy is secured by reducing eccentric errors of the conveying roller and the encoder as much as possible so as to tolerate to a certain extent dispersion of the stop accuracy caused by the control.

For this reason, in the conventional method, the analog encoder and the large-diameter codewheel are adopted, thereby increasing cost. Further, in any manner, with respect to the small-period change such as the torque change (or speed change) due to cogging of the motor, the torque (or speed) is forcibly suppressed immediately before the motor stops. Thus, there is a problem that the stop accuracy tends to be influenced and the stop control becomes complicated, because of dispersion caused by mass production regarding the cogging torque ripple of the motor.

Further, for example, control of a pitch in the torque change and the speed change smaller than the period of the cogging torque ripple of the motor, such as an interlock change of a gear and a belt acting as driving transmission means, is more difficult, whereby such an inconvenience can not be solved by the conventional method.

SUMMARY OF THE INVENTION

An object of the present invention is to provide a recording apparatus equipped with a conveying configuration in which stop accuracy of a recording medium is not influenced by a torque (speed) ripple of a conveying motor or a transmission means and which is highly accurate and of low cost.

Another object of the present invention is to provide a recording apparatus which comprises a conveying roller for conveying a recording medium, a conveying motor for generating driving force to drive the conveying roller, a driving transmission means for transmitting the driving force of the conveying motor to the conveying roller, a detecting means for detecting a rotation angle of the conveying roller, and a control means for controlling driving and stopping of the conveying roller on the basis of a signal from the detecting means, wherein a conveying quantity of the recording medium at a time of recording operation is an integer multiple of a conveying quantity of the recording medium corresponding to one period of a torque change or a speed change caused by the conveying motor or the driving transmission means.

DETAILED DESCRIPTION OF THE PREFERRED EMBODIMENTS

Hereinafter, the embodiments of the present invention will be explained in detail with reference to the attached drawings.

First Embodiment

In the present embodiment, a serial printer equipped with an inkjet head having a detachable ink tank will be explained by way of example. However, the present invention is not limited to this but applicable to a so-called line printer having a long recording head not executing a scan in a row direction.

Figure 1:
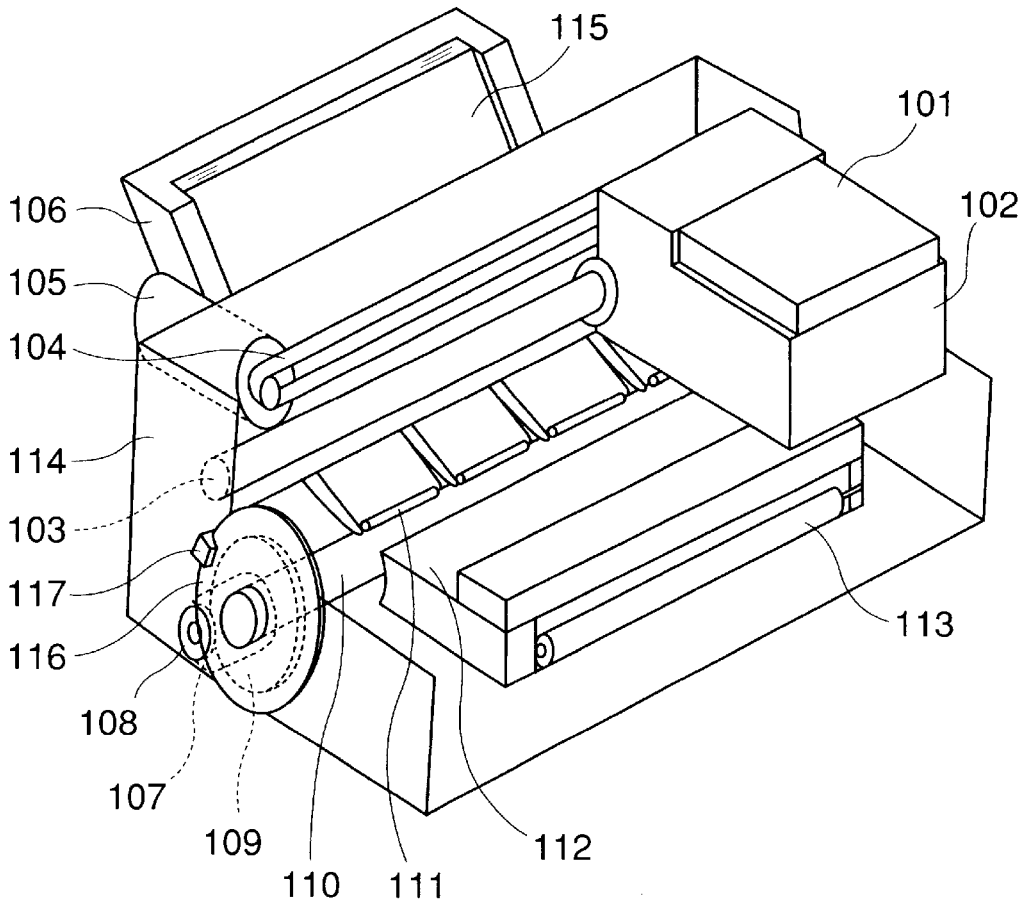
FIG. 1 is an outside perspective diagram of an inkjet printer according to a first embodiment.

FIG. 1 is an outside perspective diagram of the serial inkjet printer being an example of a recording apparatus to which the present invention is applied. In FIG. 1, a guide shaft 103 slidably guiding a carriage 102 in a main scan direction is fixed to a chassis 114 of the printer. A cartridge-type recording head 101 detachably having the ink tank is exchangeably mounted on the carriage 102. A belt 104 acting as a driving transmission means is engaged to the part of the carriage 102, and put (or wound) on a pulley and a rotation axis of a carriage motor 105 acting as a driving means, along the guide shaft 103. Thus, by driving the carriage motor 105, the carriage 102 equipped with the recording head 101 can be shifted in the main scan direction.

A recording sheet (recording medium) 115 fed from a sheet feed base 106 is conveyed toward a direction intersecting the main scan direction (preferably a direction perpendicular to the main scan direction) by a conveying roller 110, and recording is then executed on a platen 112 by the recording head 101. The conveying roller 110 is rotatably attached to the chassis 114. A pinch roller 111 rotating pursuant to the conveying roller 110 is arranged on the conveying roller 110 in the state that the roller 111 is being pressurized by a pinch roller spring (not shown).

A conveying roller gear 109 is attached to the end of the axis of the conveying roller 110. A motor gear 108 attached to the rotation axis of a conveying motor 107 acting as a DC motor is engaged with the conveying roller gear 109.

A codewheel 116 is fitted into the axis of the conveying roller 110, and an encoder sensor 117 is disposed on the periphery of the codewheel 116.

As the recording head 101, a configuration in which a droplet is emitted from a nozzle by using film boiling caused by thermal energy applied to liquid is applicable, and also another configuration in which a thin film element is minutely displaced according to an electrical signal input thereto to cause a nozzle to emit liquid is applicable.

The recording sheets 115 are being stacked on the sheet feed base 106 while such the printer is on standby for recording, and the sheet 115 is fed inside the apparatus by a not-shown sheet feed roller when the recording starts. The conveying roller 110 is rotated by driving force of the conveying motor 107 acting as the DC motor through a train of gears (the motor gear 108, the conveying roller gear 109) acting as the driving transmission means, to convey the fed recording sheet 115. Then, the recording sheet 115 is conveyed by an appropriate conveying quantity by the conveying roller 110 and the following pinch roller 111, and the conveying quantity is controlled by detecting and counting a slit (not shown) on the codewheel (rotary encoder film) 116 at the end of the axis of the conveying roller 110 by means of an encoder sensor 117, thereby enabling highly accurate conveying of the recording sheet.

Thus, while the carriage is scanned, the recording of one line is executed by causing the recording head 101 to emit ink droplets onto the recording sheet 115 pressed to the platen 112 on the basis of image information.

By alternately repeating the carriage scan and intermittent sheet conveying as above, a desired image is formed on the recording sheet 115. After the image forming has ended, the recording sheet 115 is discharged by a discharge roller 113, whereby the recording operation completes. Here, it should be noted that the phrase "recording" implies, in addition to forming of characters and figures, forming of mere diagrams having no meaning.

Next, the sheet conveying quantity (i.e., distance) by the conveying roller, which characterizes the present invention, will be explained.

Figure 2:
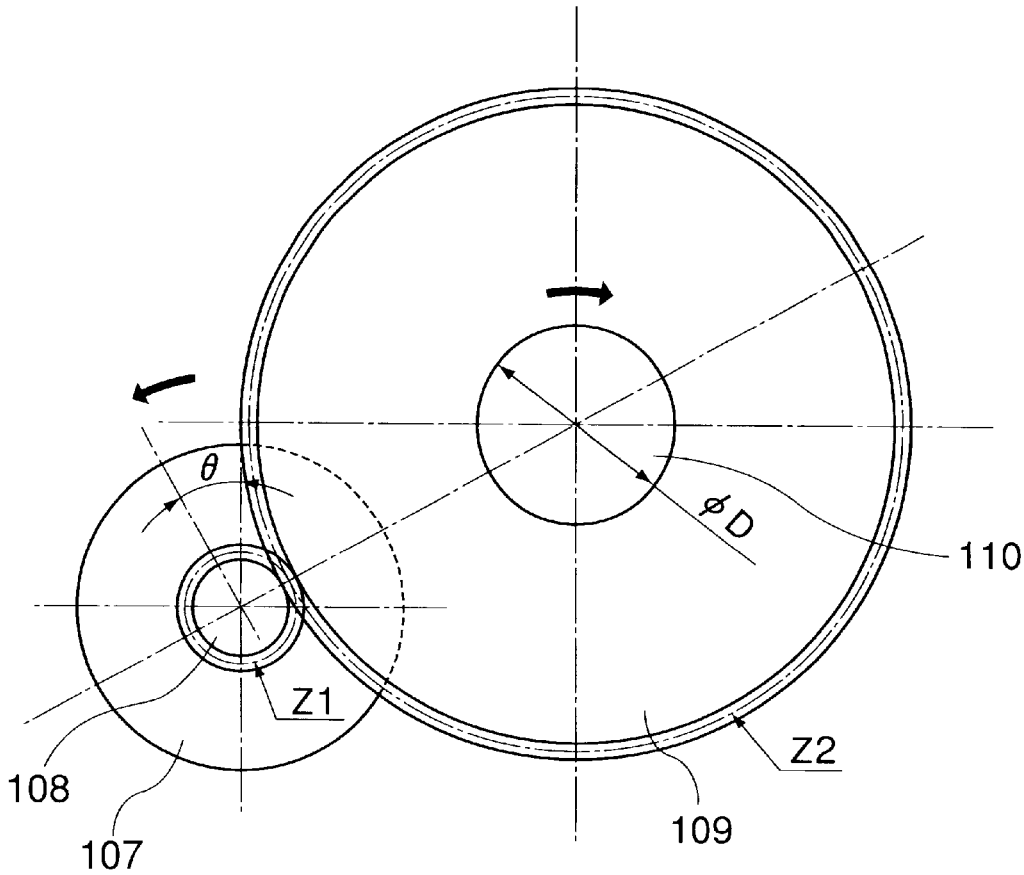
FIG. 2 is a diagram for explaining the structure of a driving transmission means according to the first embodiment.

FIG. 2 is a diagram for explaining the structure of the driving transmission means shown in FIG. 1. In FIG. 2, it is assumed that the number of teeth of the motor gear 108 is given by Z1, the number of teeth of the conveying roller gear 109 is given by Z2, and the conveying diameter of the conveying roller 110 is given by $\phi D$. Here, if the conveying motor 107 is rotated by a certain angle $\theta$ (rad), the recording sheet 115 is conveyed with the conveying roller 110 by $\pi D\times(Z1/Z2)\times(\theta/2\pi)$.

Figure 3:
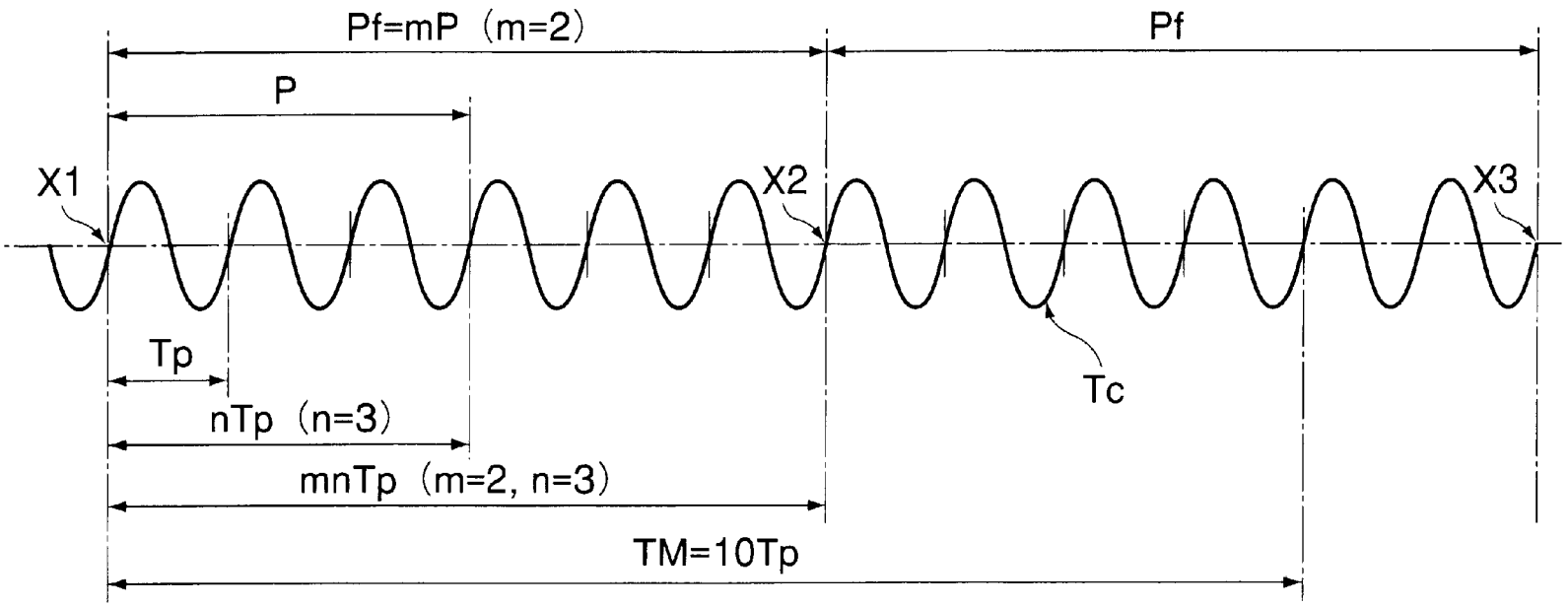
FIG. 3 is a diagram showing relation between a cogging torque ripple of a conveying motor and a recording sheet conveying quantity by a conveying roller, according to the first embodiment.

Next, FIG. 3 shows relation between a cogging torque ripple Tc of the conveying motor 107 acting as the DC motor and the recording sheet conveying quantity by the conveying roller. In the graph of FIG. 3, the longitudinal axis indicates torque (or may indicate speed), and the lateral axis indicates the recording sheet conveying quantity by the conveying roller. According to the characteristic of the DC motor, for example, if the DC motor having a two-pole magnet and five slots is used, in general magnet, rotor and magnetization conditions, ten-period torque changes (cogging torque ripples) arise in a period TM of one rotation of the motor because of balance of magnetic force as shown in FIG. 3. That is, a similar torque change period Tp arises every 1/10 period of the motor. Although the torque changes (or the speed changes) might be slightly different from others due to an axial loss of the motor, mechanical balance and electrical balance, this periodicity is not greatly degraded because the period itself is determined by the structure of the motor.

Here, a basic minimum conveying pitch P used in the intermittent sheet conveying or the like when the image is formed is matched with an integer multiple of the conveying quantity Tp corresponding to one period of the cogging torque ripple (or the speed change due to cogging) ($P=n\times Tp$, n is an integer). Further, a whole conveying quantity Pf capable of being in existence in each mode is matched with an integer multiple of the basic minimum conveying pitch P ($Pf=m\times P$, m is an integer).

Then, if it is assumed that a cogging torque ripple angle period of the motor is given by $\theta t$ (rad), the conveying quantity Pf is given by a following expression.

$$Pf=m\times P=m\times n\times Tp=m\times n\times\pi\times D\times(Z1/Z2)\times(\theta t/2\pi) \quad (1)$$

(where m and n are integers, and m=2 and n=3 in FIG. 3)

If a deceleration ratio to satisfy the above expression is determined (i.e., if the number of teeth Z1 and the number of teeth Z2 are determined), as shown in FIG. 3, when the conveying of the determined conveying pitch Pf is executed, a cogging torque ripple phase angle at the motor stop is always constant. When the motor is at a position X1, the motor shifts to a position X2 if the conveying of the pitch Pf is executed, and the motor further shifts to a position X3 if the conveying of the pitch Pf is further executed. Each stop point is at the same-phase position on the cogging torque ripple Tc.

As a result, the cogging torque causing disturbance at each stop position is always similar or approximate, and also prestop disturbance torque is approximate every time the motor stops, whereby servo-controlled speed is substantially constant. Thus, since such two conditions are stable, also the motor stop position is stable.

If the cogging torque ripple phase angle is different at each motor stop, the stop position deviates from the stop target (OFF timing for stopping driving of the DC motor). However, if the cogging torque ripple phase angle is the same at each conveying, the stop position is substantially the same every time the motor stops, whereby accuracy of the conveying pitch being the relative stop position can be secured. That is, in FIG. 3, although the phase angle at each conveying pitch Pf is always 0°, the phase angle itself need not be 0°. Thus, even if another phase angle (e.g., 45°, 90°, 135° or the like) is given, it may be employed on the condition that such the phase angle be always constant.

In the above expression (1), if n=the number of slots of the motor×2, the basic minimum conveying pitch P is equal to the period TM of one rotation of the motor, whereby the motor can stop in the state that, as well as the period of the cogging torque ripple (cogging period), a motor one-period torque change (a torque change in the period of the motors) due to the axial loss of the motor or the motor structure is always the same, thereby further increasing accuracy.

Although m=2 and n=3 are given by way of example, the present embodiment is not limited to these values. That is, the value m only has to be an integer even if the conveying quantity becomes variable during the recording, and the value n only has to be an integer even when the deceleration ratio is determined. Further, the number of magnetic poles of the DC motor and the number of slots are not limited to the values described in the present embodiment.

In this method, the deceleration ratio only has to be set, and the encoder information of the excessively small pitch used to strictly control the torque change (and the speed change) due to the cogging period is not necessary, whereby neither special parts nor the control are necessary. For this reason, restriction on the size of the codewheel and the kind of encoder is small, whereby there is a significant merit that the conveying of high accuracy can be achieved cheaply and easily.

Further, although in the present embodiment the whole conveying quantity Pf is matched with the integer multiple of the conveying quantity Tp corresponding to one period of the change due to the cogging, the whole conveying quantity Pf need not necessarily be matched and the speed may be preferentially set in a skip conveying executed mode where an adjacent image area does not exist, in a high-speed recording mode where image quality is no object, and the like.

In the present embodiment, the one-step deceleration gear as shown in FIG. 2 has been explained by way of example. However, with respect to a multi-step deceleration gear train, similarly, the basic minimum conveying pitch of the sheet can be easily matched with an integer multiple of the sheet conveying quantity by the rotation of the conveying motor corresponding to one period of the cogging torque ripple of the motor. Further, even in case of using a belt having gear teeth (a cogged belt or timing belt) as the driving transmission means, it is apparent that the same effect as above can be obtained by replacing the above gear with a cogged-belt pulley, and such a modification does not at all deviate from the scope of the present invention.

Further, in the present embodiment, as the manner to match the whole conveying quantity with integer multiple of the cogging torque change period, the basic minimum conveying pitch being as much as an integer multiple of the cogging torque change period is provided, and then the whole conveying quantity is set to be an integer multiple of this pitch. However, the present invention is not limited to this, and the whole conveying quantity only has to be an integer multiple of the cogging torque change period. That is, the present invention is not limited to the structure that the whole conveying quantity is an integer multiple of the basic minimum conveying pitch.

Second Embodiment

Next, with respect to the second embodiment of the present invention, only the parts different from the first embodiment will be explained. Here, it should be noted that the functions same as those in the first embodiment will be explained respectively with the numerals and symbols same as those in the first embodiment.

Figure 4:
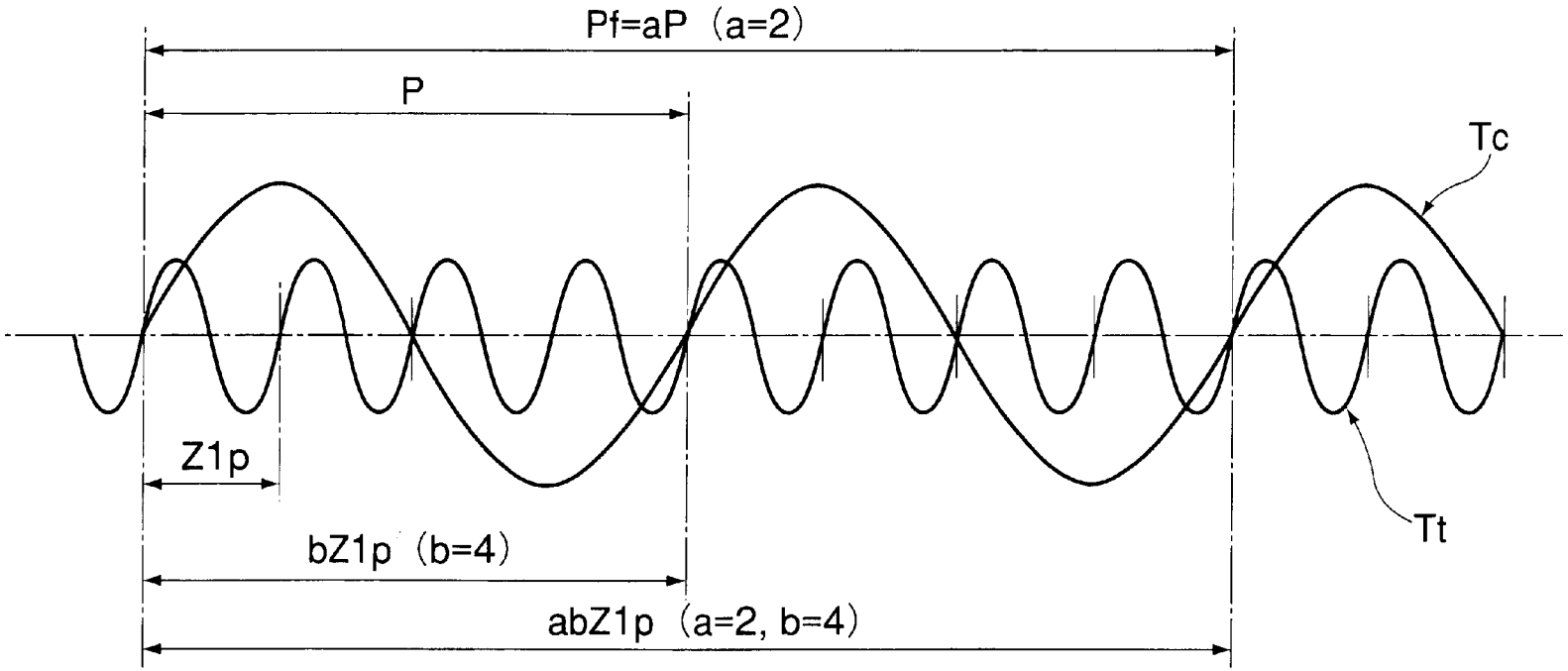
FIG. 4 is a diagram showing relation between a torque change (a speed change) due to an interlock period of a gear and a recording sheet conveying quantity by a conveying roller, according to the second embodiment.

FIG. 4 is a diagram showing relation between a torque change (speed change) (Tt) due to an interlock period of a gear and a recording sheet conveying quantity by a conveying roller. In the graph of FIG. 4, the longitudinal axis indicates torque (or may indicate speed), and the lateral axis indicates the recording sheet conveying quantity by the conveying roller. Further, symbol Z1*p* indicates the recording sheet conveying quantity corresponding to one period of a torque change (speed change) due to interlock of the motor gear 108 (=a torque change pitch Z2*p* due to interlock of the conveying roller gear 109).

Although the torque change shown here is minute, it is difficult to follow this change by servo control because the pitch is small. Since this change is seriously influenced by a disturbance torque particularly in a case where stop control is executed by using a DC motor, it is necessary to mechanically eliminate this influence beforehand.

In the present embodiment, a basic minimum conveying pitch P of a sheet used in image forming is matched with an integer multiple of the recording sheet conveying quantity Z1*p* corresponding to one period (pitch period) of the torque change (speed change) due to the interlock (P=b×Z1*p*, b is an integer). Further, a whole conveying quantity Pf capable of being in existence in each mode is matched with an integer multiple of the basic minimum conveying pitch P (Pf=a×P, a is an integer).

That is, the number of teeth Z1 and the number of teeth Z2 are determined such that Pf=a×P=a×b×Z1*p* is given (where Z1*p*=Z2*p*, and a=2 and b=4 in FIG. 4).

As a result, the interlock torque and speed causing the disturbance are always approximate with respect to the conveying quantity Pf in all modes, whereby the stop position is stable because such the two conditions as above are stable.

Further, as shown in FIG. 4, according to the present embodiment and the first embodiment, more accurate sheet conveying can be achieved by simultaneously matching the sheet conveying quantity Pf with an integer multiple of the sheet conveying quantity corresponding to one period of a cogging torque ripple Tc of the conveying motor 107.

In this method, a deceleration ratio only has to be set, and encoder information (e.g., an encoder slit) of an excessively small pitch used to strictly control the torque change (and the speed change) due to the gear interlock is not necessary, whereby neither special parts nor the control are necessary. For this reason, restriction on the size of a codewheel and a kind of encoder is small, whereby there is a significant merit that the conveying of high accuracy can be achieved cheaply and easily.

Like the first embodiment, although a=2 and b=3 are given by way of example in the present embodiment, the present invention is not limited to these values. That is, the value a only has to be an integer even if the conveying quantity becomes variable during the recording, and the value b only has to be an integer even when the number of teeth is determined. Further, although in the present embodiment the conveying quantity Pf in all modes is matched with an integer multiple of the recording sheet conveying quantity Z1*p* corresponding to the pitch (one period) of the torque change (speed change) due to the interlock, the conveying quantity Pf need not necessarily be matched and the speed may be preferentially set in a skip conveying mode where an adjacent image area does not exist, in a high-speed recording mode where image quality is no object, and the like.

Further, in the present embodiment, the one-step deceleration gear has been explained by way of example. However, with respect to a multi-step deceleration gear train, similarly, the basic minimum conveying pitch of the sheet can be easily matched with an integer multiple of the sheet conveying quantity by the rotation of the conveying motor corresponding to one period of the torque change (speed change) due to the interlock. Further, even in case of using a belt having gear teeth (a cogged belt or timing belt) as the driving transmission means, it is apparent that the same effect as above can be obtained by replacing the above gear with a cogged-belt pulley, and such a modification does not at all deviate from the scope of the present invention.

Further, in the present embodiment, as the manner to match the whole conveying quantity with an integer multiple of the cogging torque change period, the basic minimum conveying pitch being as much as an integer multiple of the cogging torque change period is provided, and then the whole conveying quantity is set to be an integer multiple of this pitch. However, the present invention is not limited to this, and the whole conveying quantity only has to be an integer multiple of the cogging torque change period. That is, the present invention is not limited to the structure that the whole conveying quantity is an integer multiple of the basic minimum conveying pitch.

As described above, according to the present embodiment, in the recording apparatus which forms an image by using the recording means while intermittently conveying the recording medium, the conveying quantity of the recording medium by the conveying roller is matched with an integer multiple of the recording medium conveying quantity by the rotation of the conveying roller corresponding to one period of the change due to the cogging of the DC motor acting as the driving motor of the conveying roller, whereby the phase angle of the cogging torque ripple being the disturbance at the time of stopping the DC motor is always the same, the prestop speed is approximate, and thus the low-speed driving before the motor stops is stabilized and also the stop position is stabilized. As a result, conveying pitch accuracy can be secured, and an image of higher quality can be formed. To achieve this, the deceleration ratio of the driving transmission means only has to be set such that the conveying quantity by the conveying roller becomes an integer multiple of the recording medium conveying quantity corresponding to the cogging period of the DC motor. Thus, since an excessive information quantity for detecting the conveying position is not necessary, restriction for the structure and performance of a position detecting means (e.g., an encoder) is small and thus can be achieved cheaply and easily.

In addition, by matching the recording medium conveying quantity of the conveying roller with an integer multiple of the recording medium conveying quantity corresponding to a rotation of the conveying motor, it is possible to eliminate conveying accuracy from being influenced by a characteristic of the conveying motor and eccentricity of a motor output gear (pulley), whereby the conveying of higher accuracy can be achieved cheaply and easily.

Further, by matching the recording medium conveying quantity of the conveying roller with an integer multiple of the recording medium conveying quantity by the rotation of the conveying roller corresponding to one period of the change due to the interlock of the gear and the belt acting as the driving transmission means, the torque change (speed change) of excessively small pitch which is hard to be controlled can be synchronized in the same manner as in case of the above change due to the cogging, whereby the conveying of higher accuracy can be achieved without increasing costs.

What is claimed is:

1. A recording apparatus comprising:

a conveying roller for conveying a recording medium;

a conveying motor for generating a driving force to drive said conveying roller;

driving transmission means for transmitting the driving force of said conveying motor to said conveying roller;

detecting means for detecting a rotation angle of said conveying roller; and control means for controlling driving and stopping of said conveying roller, said control means executing the control on the basis of a signal from said detecting means, wherein a conveying quantity of the recording medium at a time of a recording operation is an integer multiple of a conveying quantity of the recording medium corresponding to one period of a torque change or a speed change caused by said conveying motor or said driving transmission means.

2. An apparatus according to claim 1, wherein said conveying motor is a DC (direct current) motor.

3. An apparatus according to claim 1, wherein the torque change or the speed change is a cogging change caused by said conveying motor.

4. An apparatus according to claim 1, wherein the conveying quantity of the recording medium is an integer multiple of a conveying quantity of the recording medium due to one rotation of said conveying motor.

5. An apparatus according to claim 1, wherein said driving transmission means includes a train of gears, and the torque change or the speed change is an interlock change caused by said train of gears.

6. An apparatus according to claim 1, wherein the whole conveying quantity used in image forming on the recording medium is an integer multiple of a conveying quantity of the recording medium corresponding to one period of the torque change or the speed change caused by said conveying motor or said driving transmission means.

7. An apparatus according to claim 1, wherein said recording apparatus is an inkjet recording apparatus.

8. An apparatus according to claim 1, wherein said recording apparatus is a serial recording apparatus which forms an image by executing a scan of a carriage equipped with a recording head while intermittently conveying the recording medium.

9. A recording apparatus comprising:

a conveying roller for conveying a recording medium;

driving transmission means for transmitting a driving force to said conveying roller;

a conveying motor for generating the driving force; and position detecting means for detecting a position of said conveying roller, wherein driving and stopping of said conveying roller is controlled based on a signal from said position detecting means, and wherein a conveying quantity of the recording medium by said conveying roller is an integer multiple of a conveying quantity corresponding to one period of either a torque change caused by said conveying motor, or a speed change of said conveying motor.

10. An apparatus according to claim 9, wherein the conveying quantity Pf of the recording medium by said conveying roller is an integer multiple of $\pi D\ (Z1/Z2)(\theta t/2\pi)$, wherein D is the diameter of said conveying roller, Z1 is the number of teeth of a motor gear, Z2 is the number of teeth of a conveying roller gear, and $\theta t$ is an angle of said conveying motor for one cogging period.

* * * * *